US005899370A

United States Patent [19]

Bould

[11] Patent Number: 5,899,370

[45] Date of Patent: May 4, 1999

[54] WATCHSTRAP

[75] Inventor: Fred Bould, Palo Alto, Calif.

[73] Assignee: Strokz Digital Sports, Inc., Richardson, Tex.

[21] Appl. No.: 08/799,344

[22] Filed: Feb. 13, 1997

[51] Int. Cl.[6] ..... A44C 5/00

[52] U.S. Cl. ..... 224/175; 224/164; 24/265 WS

[58] Field of Search ..... 224/164, 169, 224/170, 175, 179, 903; 24/265 WS; 368/281, 282

[56] References Cited

U.S. PATENT DOCUMENTS

| | | | |
|---|---|---|---|
| 1,176,840 | 3/1916 | Lewis | 224/903 |
| 1,195,299 | 8/1916 | Wachter | 224/170 |
| 2,189,096 | 2/1940 | Alonge | 224/170 |
| 4,023,347 | 5/1977 | Haber | 368/282 |
| 4,462,697 | 7/1984 | Thompson | 368/282 |
| 4,627,738 | 12/1986 | Kao | 368/281 |
| 4,742,502 | 5/1988 | Tomoda | 224/170 |
| 4,742,503 | 5/1988 | Braun et al. | 368/282 |
| 4,970,708 | 11/1990 | Gagnebin et al. | 368/281 |
| 5,228,012 | 7/1993 | Seager | 24/265 WS |
| 5,540,367 | 7/1996 | Kauker | 224/903 |

FOREIGN PATENT DOCUMENTS

| | | | |
|---|---|---|---|
| 3540737 | 5/1987 | Germany | 24/265 WS |
| 463904 | 6/1951 | Italy | 224/170 |
| 70941 | 11/1915 | Switzerland | 224/170 |

*Primary Examiner*—Allan N. Shoap
*Assistant Examiner*—Gregory M. Vidovich
*Attorney, Agent, or Firm*—Gardere & Wynne, L.L.C.

[57] ABSTRACT

An integrally formed watch band with a circular-shaped flexible harness having two strap portions extending from opposite ends therefrom. The harness has an a top opening through which a timepiece, when inserted, is made visible. The bottom of the harness has two oppositely extending flexible tab portions which support the timepiece in place within the harness. The harness is circular and flexible enough to accommodate a wide range of timepiece configurations. In one embodiment, molded cutouts line the inner wall of the harness and are arranged in locations that correspond with control buttons of a specific timepiece configuration.

4 Claims, 3 Drawing Sheets

WATCHSTRAP

The invention relates in general to an improved watch band and more specifically to a single piece combination harness and strap that secures a timepiece to the wrist and protects it during use.

BACKGROUND OF THE INVENTION

Without limiting the scope of the invention, its background is described in connection with watch straps of the type readily available in industry.

Standard watchbands consist of two straps that extend from opposite ends of a watch and around the wearer's wrist. Typically, each strap is secured to one end of a watch with a pin, which extends into and through a loop in the strap and attaches to a support on the watch. The straps extend over and around the wrist and are secured to each other using a buckle, locking clasp or other similar fastening mechanism. Variations of these two strap configurations are also available.

A less popular type of watchband uses a single strap that extends under the base of the watch and fastens to the wrists with a buckle. The strap is fed into a space created by a holding pin and a perimeter portion of the watch at one end and is then pulled through a similar space near the opposite end of the watch. Thus, during use, a portion of the strap lies between the watch and the wearer's wrist.

With prior art wristband configurations, watch functions are controlled by the wearer using dials, function buttons or other controls protruding out from the watch into open air. In some instances, the controls may be scuffed or damaged, especially in situations where the wearer is engaged in athletic activity. The strap offers no protection to the actual timepiece as its only purpose is to hold the watch in place on the wearer's wrist.

Advances in watch technology have resulted in complex multifunction timepieces that offer stopwatch, lapcounter, calendar and memory capabilities among others. Small low power consuming microcomputers have been incorporated inside the watch chamber of the wristwatch to create devices suitable for recreational use, training or athletic competition. Such "sport watches" have functions that give the user a gauge of distance, time and/or number of repetitions per unit of time and are ideal for events such as biking, running or rowing. With such activities, the wearer desires a watch that is lightweight and does not interfere with the athlete's natural action.

Sports watches have also become a standard piece of equipment in many water events such as scuba diving and swimming. Waterproof materials and chamber designs that resist forces to hundreds of meters have been used to create highly functional underwater timepieces. With swimming events in particular, where time measurements are critical, the wearer desires a design that is smooth and does not obstruct the swim stroke motion.

As with other types of watches, however, the sport watch strap serves no other purpose other than to hold the watch on the wearer's wrist. Sport watch straps of today are not a functional and integral part of the total watch ergonomics. They do not protect the watch from damage during use nor do they enhance the aerodynamic qualities of the watch-strap combination.

SUMMARY OF THE INVENTION

Disclosed herein according to one embodiment is an improved watchband that provides numerous advantages over the prior art.

As such, a primary advantage of the invention is its single piece construction that integrates the wrist strap with the watch harness. In this regard, the band is integrally molded from a single piece of flexible material having a harness with two outwardly extending strap portions. The strap portions extend around the wearer's wrist and secure the timepiece securely to the wearer's wrist during use.

Another advantage of the present invention is its improved ergonomic design as compared to prior art wristbands. In this regard, the watch harness holds the timepiece firmly in place during use. The harness, in turn, has an inner wall that extends around and over the timepiece but with an opening that leaves the watch display visible to the eye. The bottom is partially open with two oppositely extending flexible tab portions that support the timepiece inside the harness. The tab portions lie between the timepiece and the wearer's wrist during use. The harness, tabs and straps portions together define an enclosure with a smooth integrated assembly.

Yet another advantage of the invention is the ease with which the watch is inserted and removed from the band. The flexible tabs are designed to bend inward or outward to accommodate both insertion and removal. Likewise, the harness is flexibly formed to hold the timepiece in place by allowing any control buttons to contact the interior wall of the harness and protrude slightly outward making the controls accessible from the outside. In the preferred embodiment, the inner wall of the harness has a plurality of cavities forming recesses which are located at predetermined locations corresponding to the placement of control buttons for a particular watch design.

Disclosed in one embodiment is an integrally formed watch band with a flexible harness having two strap portions extending from opposite ends of the harness. The harness has a top opening through which a timepiece, when inserted, is made visible. The bottom of the harness has two oppositely extending flexible tab portions which support the timepiece in place within the harness. The harness is preferably circular in shape and is flexible enough to accommodate a wide range of timepiece configurations. In one embodiment, a plurality of recesses line the inner wall of the harness and are arranged in locations that correspond with control buttons of a specific timepiece configuration.

For a more complete understanding of the present invention, including its features and advantages, reference is now made to the following detailed description, taken in conjunction with the accompanying drawings.

BRIEF DESCRIPTION OF THE DRAWINGS

In the drawings.

Corresponding numerals and symbols in the different figures refer to corresponding parts unless otherwise indicated.

DETAILED DESCRIPTION OF THE PREFERRED EMBODIMENT

Figure 1:
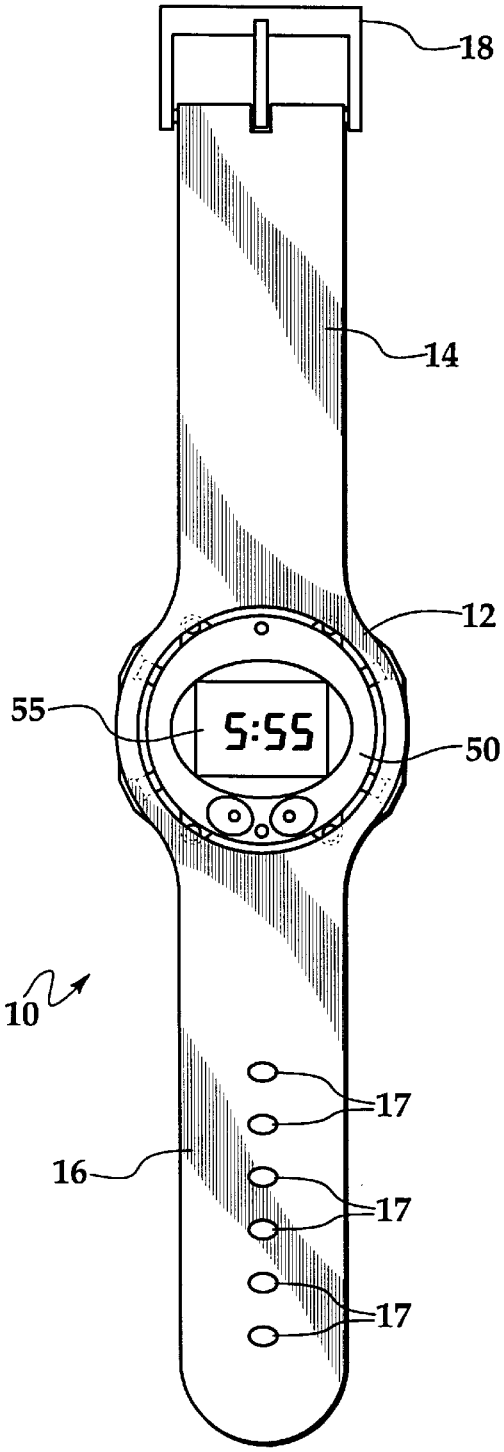
FIG. 1 is a top side view of an improved watchband according to the invention.

In FIG. 1, a top side view of the watch band 10 according to one embodiment of the invention is shown. Band 10 has a harness 12 that forms a substantially circular ring around the timepiece 50. The harness 12 secures the timepiece 50 in place and has an opening so that display 55 is visible to the user.

As shown, the harness 12 has two strap portions 14 and 16 extending therefrom in a single piece construction. Strap portion 14 has a buckle 18 attached thereto to provide a fastening means that secures the band 10 to the wearer's wrist during use. The buckle 18 is not essential to the invention and any similar fastening mechanism, such as a clasp or similar locking fixture, may be used. In one contemplated embodiment, the strap portions 14 and 16 form a single piece of elastic material that fits over the wearer's wrist during use.

Figure 2:
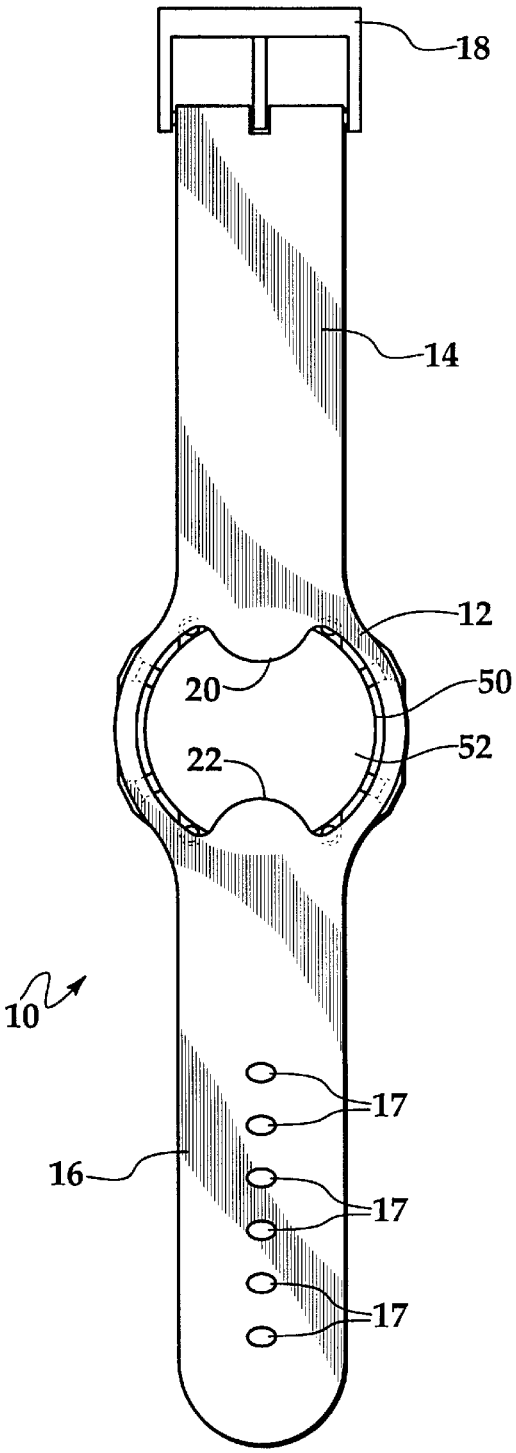
FIG. 2 is a bottom view of the watchband shown in FIG. 1.

In FIG. 2, a back side view of band 10 is shown. Extending from the back of the harness 12 are flexible tabs 20 and 22 which provide supports to the timepiece 50. The tabs 20 and 22 extend from opposite side of the harness 12 and cover a portion of the timepiece back 52. Thus, during use the tabs 20 and 22 lie between the timepiece back 52 and a portion of the wearer's wrist.

In one embodiment, harness 12, strap portions 14 and 16 and tabs 20 and 22 form a single one-piece watchband that is integrally molded from the same material. The material is preferably made of a flexible but rigid substance such as hardened plastic or rubber, although other suitable substances may be employed. The harness 12 can be transparent or see through colored depending on style. The band 10 secures the timepiece 50 securely to a user when in use and partially protects the timepiece 50 from scuffing or damage.

Figure 3:
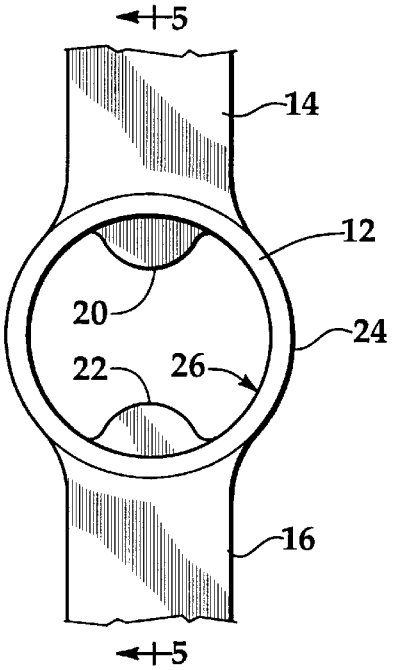
FIG. 3 is a top view of the watchband harness according to one embodiment of the invention.

Turning to FIG. 3, a top view of the harness 12 with the timepiece 50 removed is shown. Harness 12 has an outer wall 24 and inner wall 26 that stretch and flex with the insertion of the timepiece 50. The harness 12 can thus accommodate a large array of watch configurations. The harness 12 is preferably ring shaped, but other configurations and shapes are contemplated and within the scope of the invention.

As shown, the tabs 20 and 22 occupy a portion of the opening defined by harness 12. Tabs 20 and 22 are shown aligned with the strap portions 14 and 16, but it should be understood that the tabs 20 and 22 can be positioned elsewhere and that their general shape and size can vary. In one contemplated embodiment, a single tab of a generally larger size is used. In yet another contemplated embodiment, three tabs are employed. Other tab configurations will be apparent upon reference to this disclosure.

Figure 4:
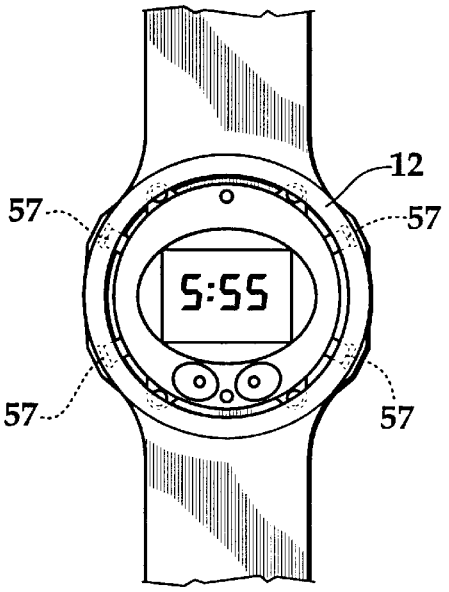
FIG. 4 is a top view of the watchband harness shown in FIG. 3 with the timepiece in place.

In FIG. 4, a top view of the harness 12 with the timepiece inserted is shown. Preferably the timepiece 50 is inserted from the back of the harness 12 by bending tabs 20 and 22 and harness 12 as needed. The harness 12 and tabs 20 and 22 would flex accordingly to accommodate insertion of the timepiece 50 and return to their natural manufactured shape.

Control buttons 57 are used to operate the various watch functions provided by the specific timepiece 50 design. As shown, the controls 57 fit inside the ring portion of the harness 12 and make contact with inner wall 26 causing a bulging effect of the outside wall 24. This bulging effect serves two primary purposes. First, the bulging effect tends to secure the timepiece 50 in place firmly ensuring that it does not dislodge or rotate during use. Second, the bulging effect provides the user with an indication as to the location of the control buttons 57.

It should be understood that band 10 is not specific to any particular watch design or configuration. As such, the radius and width of the harness 12 can vary to accommodate various watch configurations.

Figure 5:
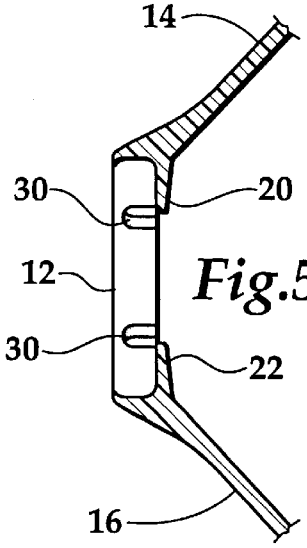
FIG. 5 is a cross-sectional view of the harness of FIG. 3 as seen along line 5—5.

In FIG. 5, a cross-sectional view of the band 10 is shown. The strap portions 14 and 16 are angularly displaced about the corresponding tab portions 20 and 22 to which they attach. A plurality of cavities 30 line the inner wall 26 of the harness 12 and form recesses thereon. Preferably, the number of cavities 30 and their respective positions on wall 26 correspond to the number of controls 57 and their location on a particular watch design. The cavities are provided to help secure the timepiece 50 firmly in place within the harness 12 and would be shaped and sized according to controls 57.

Figure 6:
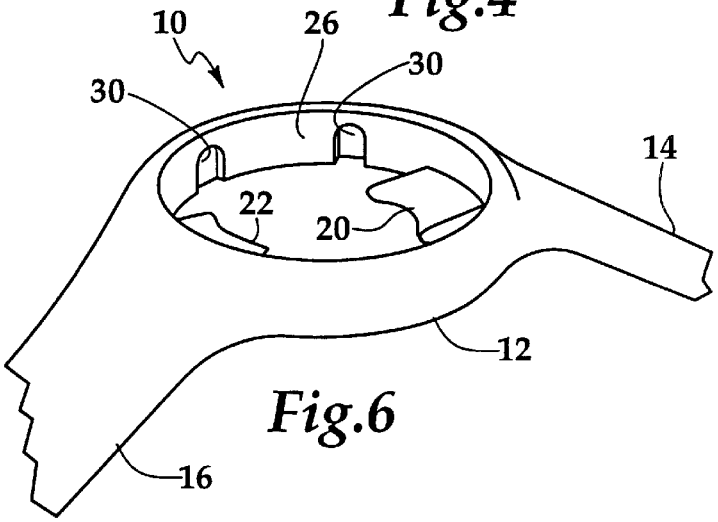
FIG. 6 is a perspective view of the watchband illustrating bottom opening cavities according to one embodiment.
Figure 7:
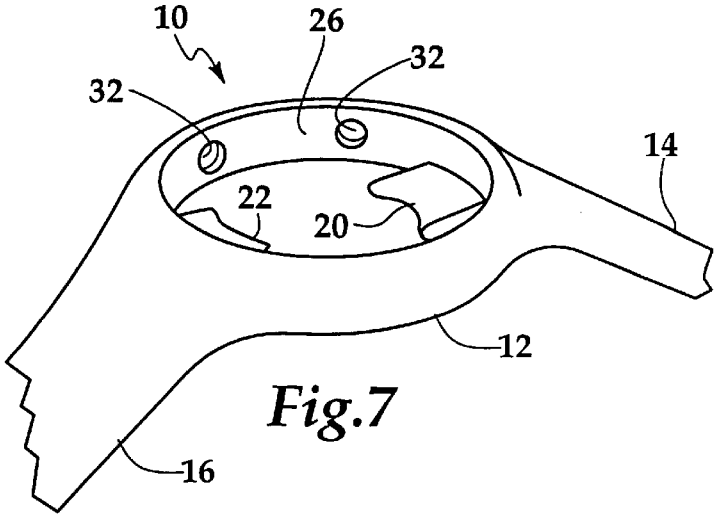
FIG. 7 is a perspective view of the watchband illustrating center spaced cavities according to a second embodiment.

In FIGS. 6 and 7, perspective views of the band 10 according to two contemplated embodiments are shown. More particularly, FIG. 6 shows a band 10 with a plurality of bottom open cavities 30 that line inner wall 26. During insertion of the timepiece 50, the controls 57 slide into the cavities 30 from the bottom part of the harness 12. Tabs 20 and 22 flex to permit insertion of the timepiece 50 and the cavities 30 act as guides to orient the timepiece into it proper place within the harness 12.

In contrast, in FIG. 7 the cavities 32 are not bottom opening but are center spaced with respect to the harness 12 about the inner wall 26. Proper insertion of the timepiece 50 into the harness 12 requires positioning by the user to ensure the controls 57 fit into the cavities 32.

Figure 8:
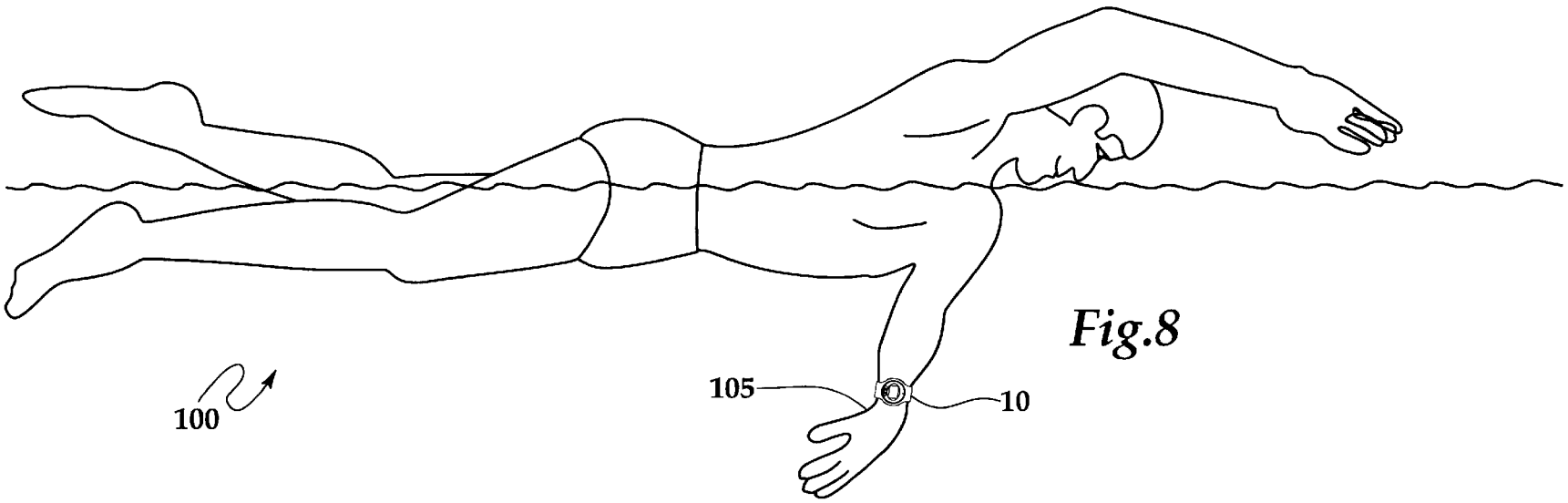
FIG. 8 illustrates a contemplated use of the watchband in an underwater activity.

Turning to FIG. 8, a contemplated use of the band 10 in a water activity is shown and denoted generally as 100. The band 10 and timepiece 50 are securely fastened to the wearer's wrist 105 during use 100 and do not interfere with the wearer's swim stroke in the water. The band's ergonomic design and one-piece construction help reduce resistance as the wearer's hand glides through the water. It should be understood that similar advantages would be present in other activities such as running, rowing or biking.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An integrally molded watchstrap for receiving a timepiece having at least one control button, the watchstrap comprising:

a harness forming a ring with first and second tab portions extending from an inner wall of the ring for retaining the timepiece in the harness, wherein the harness is flexibly formed to hold the timepiece in place by allowing the at least one control button on the timepiece to contact the inner wall of the harness wherein a portion of an outer wall of the ring opposing the contact of the at least one button with the inner wall protrudes slightly outward there from making the at least one control button accessible from the outside of the harness;

first and second strap portions extending from opposite ends of the harness; and a fastening mechanism coupled to the strap portions for securing the watchstrap to a wearer's wrist.

2. The watch strap according to claim 1 wherein the harness has a substantially circular shape.

3. The watchstrap according to claim 1 further comprising at least one cavity formed along the inner wall of the ring for respectively accepting the at least one control button on the timepiece.

4. An integrally molded watchstrap for receiving a timepiece having a plurality of control buttons, the watchstrap comprising:

a harness forming a substantially circular ring with first and second tab portions extending from an inner wall of the ring for retaining the timepiece in the harness, wherein the harness is flexibly formed to hold the timepiece in place by allowing the control buttons on the timepiece to contact the inner wall of the harness wherein a portion of an outer wall of the ring opposing the contact of each of the control buttons with the inner wall protrudes slightly outward there from making the control buttons accessible from the outside of the harness;

first and second strap portions extending from opposite ends of the harness; and a fastening mechanism coupled to the strap portions for securing the watchstrap to a wearer's wrist.

* * * * *